US007647974B2

(12) United States Patent
Fenton

(10) Patent No.: US 7,647,974 B2
(45) Date of Patent: Jan. 19, 2010

(54) LARGE BORE MODULAR PRODUCTION TREE FOR SUBSEA WELL

(75) Inventor: Steven P. Fenton, Balmedie (GB)

(73) Assignee: Vetco Gray Inc., Houston, TX (US)

( * ) Notice: Subject to any disclaimer, the term of this patent is extended or adjusted under 35 U.S.C. 154(b) by 486 days.

(21) Appl. No.: 11/494,030

(22) Filed: Jul. 27, 2006

(65) Prior Publication Data

US 2008/0023204 A1 Jan. 31, 2008

(51) Int. Cl.
*E21B 43/01* (2006.01)

(52) U.S. Cl. ..... 166/368; 166/338; 166/339; 166/344; 166/347

(58) Field of Classification Search ..... 166/368, 166/338–340, 344, 347, 351
See application file for complete search history.

(56) References Cited

U.S. PATENT DOCUMENTS 5,971,077 A * 10/1999 Lilley ..... 166/368
5,992,527 A * 11/1999 Garnham et al. ..... 166/379
6,050,339 A * 4/2000 Milberger ..... 166/368
6,357,529 B1 * 3/2002 Kent et al. ..... 166/344
6,460,621 B2 * 10/2002 Fenton et al. ..... 166/347
6,966,383 B2 * 11/2005 Milberger et al. ..... 166/368
7,201,229 B2 * 4/2007 White et al. ..... 166/368
2004/0262010 A1 * 12/2004 Milberger ..... 166/368

* cited by examiner

*Primary Examiner*—Thomas A Beach
*Assistant Examiner*—Matthew R Buck
(74) *Attorney, Agent, or Firm*—Bracewell & Giuliani

(57) ABSTRACT

A subsea wellhead assembly has separable tree modules that interconnect together. The lower tree module has a lower tree member having a bore with a valve for controlling production fluid flow. The upper tree module has an upper tree member with a bore and interface devices for monitoring the fluid flow as well as controlling the flow. A production line sub is carried alongside the upper tree member. The sub has a stab interface that stabs sealingly into a stab interface mounted alongside the lower tree member.

20 Claims, 1 Drawing Sheet

LARGE BORE MODULAR PRODUCTION TREE FOR SUBSEA WELL

FIELD OF THE INVENTION

This invention relates in general to subsea oil and gas production systems and in particular to a subsea tree assembly having certain components that are retrievable by a light-duty workover vessel.

BACKGROUND OF THE INVENTION

A conventional subsea wellhead assembly includes a wellhead housing that supports one or more casing hangers, each located at the upper end of the string of casing extending into the well. A production tree landed on the wellhead housing controls the production of well fluids. A tubing hanger supports a string of tubing through which the well fluid flows. The tubing hanger may be located either in the wellhead housing or in the production tree. The tree has a choke and valves to control the flow. The tree may also have sensors for monitoring pressure, temperature and flow rate.

The more sensitive components of the tree are the flow interface devices, such as the choke, flow meter, and pressure and temperature sensors. U.S. Pat. No. 6,460,621 discloses a modular tree that has a lower module containing the valves. The upper module contains the more sensitive equipment and lands on the lower module. The upper module can be retrieved separately from the lower module for repair or replacing the flow interface devices In the '621 patent, the tree block for the lower module has two vertical passages, one for the production flow and one for communication with the tubing annulus. The upper module has also two vertical passages, one for upward flowing fluid from the production passage of the lower module, and the other for flowing fluid downward back into an upper section of the tubing annulus passage in the lower tree block. A port in the lower module connects this upper section of the tubing annulus passage to a flowline connector. A valve selectively blocks the upper section of the tubing annulus passage from the lower section while the upper section is serving as a production flow passage.

While the design of the '621 patent is feasible for many applications, the side-by-side vertical production and tubing annulus through-bores restrict the diameter of the production passage. In some instances, very large production passages are desired for wells, particularly for high flow rate gas wells.

SUMMARY OF THE INVENTION

In this invention, a lower tree module has a lower tree member that lands on and connects to the wellhead housing. The lower tree member has a single vertical, through-bore for receiving well fluid flowing up the string of tubing. A valve mounted to the lower tree member controls the well fluid flow. The lower tree module has a production line connector mounted along one side of the lower tree member with a stab interface that faces upward.

An upper tree module has an upper tree member that lands on and connects to the lower tree member. The upper tree member has a single through-bore that registers with the bore in the lower tree member. The upper tree module has at least one flow interface device, such as a choke or flow meter, to control and monitor the well fluid flow. The upper tree module has a production line sub carried alongside the upper tree member that faces downward for stabbing into the stab interface of the production line connector. The well fluid from the upper tree module thus does not return back into the lower tree member. Rather, it flows directly from the upper tree module to the flowline system.

DETAILED DESCRIPTION OF THE INVENTION

Figure 1A:
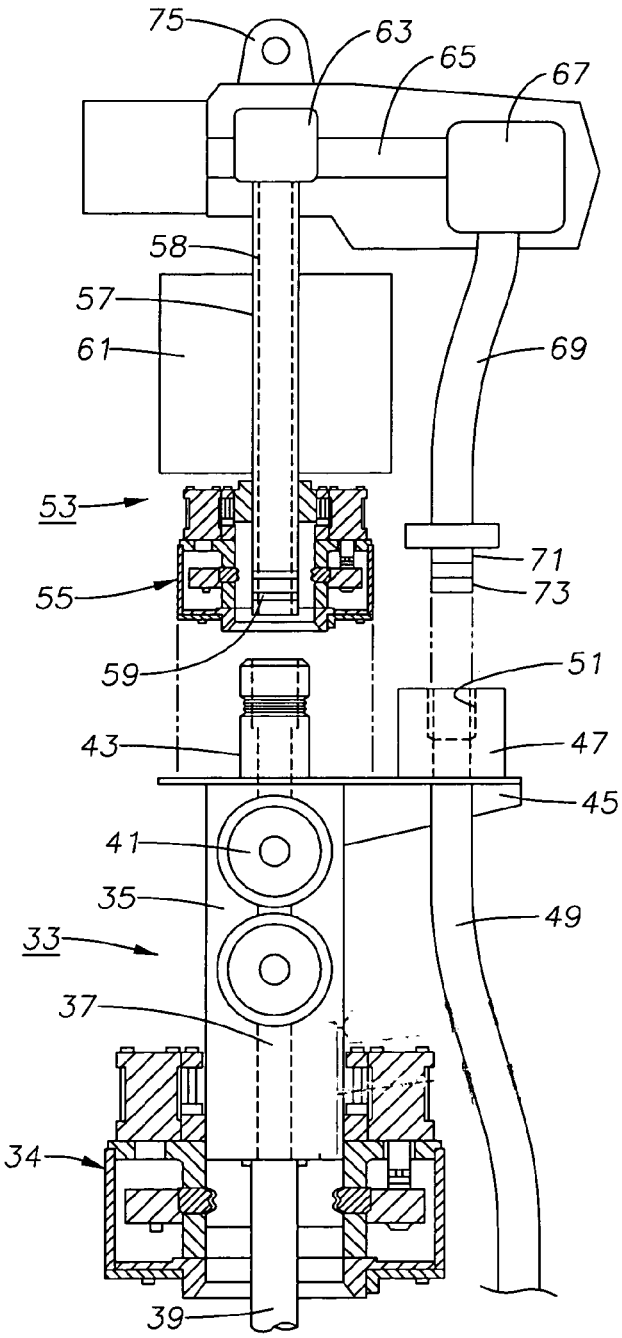
FIGS. 1A and 1B comprise a schematic telescoping and partial sectional view of a subsea wellhead assembly constructed in accordance with this invention.
Figure 1B:
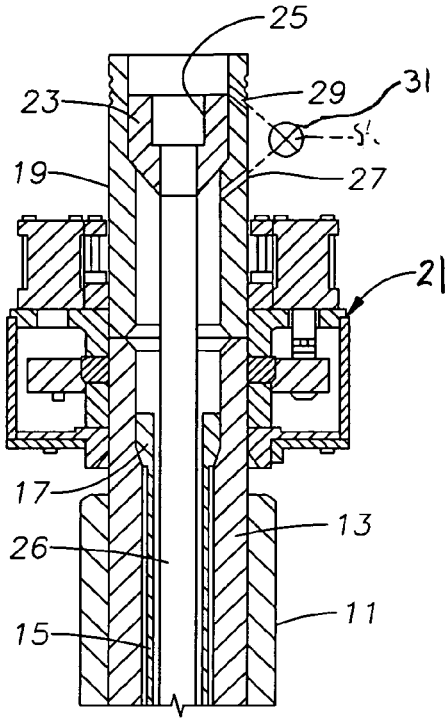

Referring to FIG. 1B, the subsea well includes a low pressure wellhead housing 11, shown schematically at the upper end of the well on the sea floor. Low pressure wellhead housing 11 is connected to a string of conductor pipe that extends to a first depth in the well. A high pressure wellhead housing 13 is connected to large diameter casing that extends to an even greater depth. The high pressure wellhead housing 13 lands in low pressure wellhead housing 11 and protrudes upward from it. At least one string of casing 15 is supported within high pressure wellhead housing 13 by a casing hanger 17.

In this example, a tubing spool 19 is secured to the upper end of high pressure wellhead housing 13 by a conventional connector 21, typically hydraulically actuated. Tubing spool 19 comprises a tubular member having a load shoulder therein for supporting a tubing hanger 23. Tubing hanger 23 has a single passage 25 extending through it, the passage 25 being in communication with a string of tubing 26 extending into the well. Well fluid will flow up tubing 26 and through passage 25 of tubing hanger 23.

During completion and certain workover operations, access must be provided to a tubing annulus that surrounds tubing 26. In this example, access is provided by a lower tubing annulus passage 27 that leads from the bore of tubing spool 19 to the exterior. An optional upper tubing annulus passage 29 leads from the exterior back into the bore of tubing spool 19. Lower and upper tubing annulus passages 27, 29 are located, respectively, below and above the seal for sealing tubing hanger 23 to tubing spool 19. Tubing annulus passages 27, 29 have valves for opening and closing either passage 27, 29, and are connected to each other by an external line containing one or more valves 31. A conduit leads from valve 31 to other subsea equipment, such as a production cross-over line (not shown). Upper tubing annulus passage 29 facilitates the use of a monobore riser (not shown) for completion and workover operations. However, it could be omitted if desired. Also, alternatively, tubing hanger 23 could be landed within high pressure wellhead housing 13 rather than utilizing a tubing spool 19.

Referring to FIG. 1A, a lower tree module 33 has a connector 34 for connecting it to tubing spool 19. Connector 34 may be the same type as connector 21. Lower tree module 33 includes a lower tree member or block 35, which is a monobore member having a single, large diameter, vertical production passage 37 extending through it. Production passage 37 communicates with a stinger 39 mounted to the lower end of tree block 35. Stinger 39 stabs into tubing hanger passage 25 when lower tree module 33 lands on tubing spool 19. Lower tree block 35 has at least one valve 41, and typically more than one as shown, for opening and closing production passage 37. A mandrel 43 is formed on the upper end of tree block 35. Tree block 35, for example, may be rectangular, but mandrel 43 has a cylindrical exterior and a grooved connector profile on its exterior. Mandrel 43 is an integral part of tree block 35, and production passage 37 extends through mandrel 43.

A mounting plate 45 is mounted to lower tree module 33. In this example, mounting plate 45 is mounted to the upper end of tree block 35 and lower end of mandrel 43 perpendicular to the axis of passage 37. Mounting plate 45 extends laterally outward and supports a production line connector 47. Production line connector 47 is secured to a conduit 49 that preferably leads downward to a flowline connector (not shown) that connects to a flowline extending along the sea floor. Production line connector 47 has a stab interface 51, which in this embodiment comprises an upward facing receptacle. The axis of receptacle 51 is parallel to and offset from the axis of production passage 37.

An upper tree module 53 lands on top of lower tree module 33. Upper tree module 53 has a conventional connector 55, which may be of the same type as connectors 34 and 21, for connection to mandrel 43. Upper tree module 53 includes an upper tree member 57, which has a vertical, large diameter monobore production passage 58 extending through it. Upper tree member 57 is preferably a cylindrical tube and stabs into a receptacle in mandrel 43. Preferably, the inner diameter of passage 58 is the same as the inner diameter of production passage 37 and also the inner diameter of tubing 26. Seals 59 on the lower end of upper tree member 57 seal in the receptacle within mandrel 43.

One or more flow interface devices 61 is mounted to upper tree module 53 in communication with the well fluid flowing upward through production passage 58. The flow interface devices may include a multi-phase flow meter as well as pressure and temperature sensors. Also, one of the flow interface devices preferably comprises a choke assembly 63. Choke assembly 63 is a conventional device that allows the operator to vary the orifice size through which the production flow passes, thereby creating a desired back pressure and controlling the fluid flow rate.

Upper tree module 53 also includes a passage 65 that leads from choke assembly 63 to an optional buffer chamber 67 for buffering the fluid flow. A production line sub 69 is connected to buffer chamber 67. Production line sub 69 is a pipe that extends downward alongside and generally parallel to upper tree tubular member 57. The lower end of production line sub 69 comprises a stab interface 71. In this embodiment, stab interface 71 comprises a stinger having seals 73 for sealing into receptacle 51 of flowline connector 47. Stab interface 71 is located at an elevation approximately at the lower end of upper tree tubular member 57 so that it will stab into sealing engagement with receptacle 51 during the same operation that the lower end of upper tree tubular member 57 stabs into mandrel 43. Preferably, upper tree module 53 is lowered on a lift line and has a hook or pad eye 75 on its upper end for connection to a lift line.

In operation, the operator will drill and complete the well by running tubing 26 in a conventional manner. The operator then lowers lower tree module 33 onto tubing spool 19 and connects it to tubing spool 19 with connector 34. Stinger 39 will simultaneously stab sealingly into bore 25 of tubing hanger 23. The operator will connect the main flowline connector, which is not shown but is located at the lower end of conduit 49, to a flow line.

If weight permits, the operator may connect upper tree module 53 to lower tree module 33 while at the surface and lower the two tree modules together on a lift line connected to pad eye 75. Otherwise, the operator will lower upper tree module 53 onto lower tree module 33 and connect connector 55 to mandrel 43 after lower tree module 33 has been previously installed on tubing spool 19. During this operation, upper tree member 57 will stab sealingly into mandrel 43, and stab interface 71 will stab sealingly into receptacle 51.

The operator opens valves 41, which allows well fluid to flow up tubing 26 through passages 37 and 58. The well fluid flows through choke 63, buffer chamber 67, down production line sub 69, and out conduit 49. Flow interface devices 61 will monitor the well flow, such as determining the pressure, temperature and flow rate, and choke 63, also a flow interface device, will control the flow rate.

The hydraulic and electrical controls (not shown) for controlling the various valves 31, 41, connectors 21, 34, and 53, and flow interface devices 61 and choke 63, are preferably located in a separately retrievable unit or units that may be mounted to either upper tree module 53, lower tree module 33, or both. Alternately, the controls may be integrated in upper tree module 53 but retrievable only with upper tree module 53 rather than separately. If a failure occurs in connection with one of the flow interface devices 61, 63, the operator may close valves 41 and pull upper tree module 53 to the surface.

The invention has significant advantages. The upper tree and lower tree modules have large bores because space doesn't need to be provided for a tubing annulus through-bore. Placing a stab interface in separate subs alongside and adjacent the tree members enables the tree member to have large diameter through-bores.

While the invention has been shown in only one of its forms, it should be apparent to those skilled in the art that it is not so limited, but is susceptible to various changes without departing from the scope of the invention.

I claim:

1. A subsea wellhead assembly, comprising:

a tubular housing for location at an upper end of a well;

a tubing hanger that lands in the housing for supporting a string of tubing extending into the well;

a lower tree member that lands on an upper end of the housing and has an external connector that connects to the housing after the tubing hanger has been installed in the housing, the lower tree member having a bore for receiving well fluid flowing up the string of tubing;

at least one valve mounted to the lower tree member for selectively closing the bore, the valve being movable in unison with the lower tree member as it is lowered and landed on the housing;

a production line connector mounted to and alongside the lower tree member for connection to a production flow line;

an upper tree member that lands on the lower tree member and has an external connector that connects to the lower tree member, the upper tree member having a bore that registers and is coaxial with the bore in the lower tree member for receiving well fluid flowing up the bore of the lower tree member, the bore of the upper tree member having a smaller diameter than a maximum width of the lower tree member, such that the lower tree member cannot pass through the bore of the upper tree member;

at least one flow interface device mounted to the upper tree member in communication with the production passage in the upper tree member; and a production line sub carried alongside the upper tree member downstream of and in fluid communication with the production passage, the sub having a lower end that sealingly engages the production line connector.

2. The subsea wellhead assembly according to claim 1, wherein the bore of the lower tree member is smaller in diameter than the tubing hanger, preventing the tubing hanger from being retrieved through the bore of the lower tree member.

3. The subsea wellhead assembly according to claim 1, further comprising:

a mounting plate connected directly to the lower tree member and extending laterally outward relative to an axis of the lower tree member; and wherein the production line connector is attached to the mounting plate.

4. The subsea wellhead assembly according to claim 1, wherein the production line connector is mounted adjacent an upper end of the lower tree member such that it moves in unison with the lower tree member as the lower tree member is lowered onto and landed onto the housing.

5. The subsea wellhead assembly according to claim 1, wherein the lower end of the production line sub stabs into sealing engagement with the production line connector during the operation wherein the upper tree member lands on the lower tree member.

6. The subsea wellhead assembly according to claim 1, wherein the production line connector has an upward facing receptacle for receiving the lower end of the production line sub.

7. A subsea wellhead assembly, comprising:

a tubular housing for location at an upper end of a well;

a tubing hanger that lands in the housing for supporting a string of tubing extending into the well;

a lower tree module that lands on an upper end of the housing and has an external connector that releasably connects to the housing, the lower tree module being located above the tubing hanger, the lower tree module having a lower tree member with a single through-bore extending vertically therethrough;

at least one valve mounted to the lower tree member for selectively controlling well fluid flow through the through-bore of the lower tree member, the valve being located above the tubing hanger;

a production line connector mounted to the lower tree module for connection to a production flow line, the production line connector having a stab interface facing upward and positioned alongside the lower tree member;

an upper tree module that lands on the lower tree module and has an external connector that connects to the lower tree module, the upper tree module having an upper tree member with a single through-bore extending vertically therethrough;

a choke assembly mounted to the upper tree module for controlling well fluid flow through the through-bore of the upper tree member; and a production line sub mounted to the upper tree module downstream of the choke assembly and extending downward alongside the upper tree member, the sub having a stab interface that sealingly engages the stab interface of the production line connector during the operation wherein the upper tree module lands on the lower tree module.

8. The subsea wellhead assembly according to claim 7, further comprising:

a mounting plate attached directly to the lower tree member and extending laterally outward relative to an axis of the lower tree member; and wherein the production line connector is attached to the mounting plate.

9. The subsea wellhead assembly according to claim 7, wherein the stab interface of the production line sub is located alongside a lower end of the upper tree member.

10. The subsea wellhead assembly according to claim 7, wherein the production line connector is mounted adjacent an upper end of the lower tree member prior to the installation of the lower tree member on the housing.

11. The subsea wellhead assembly according to claim 7, wherein the stab interface of the production line connector comprises an upward facing receptacle.

12. The subsea wellhead assembly according to claim 7, further comprising:

a wellhead housing;

a casing hanger landed in the wellhead housing for supporting a string of casing; and wherein the tubular housing lands on and connects to the wellhead housing before the tubing hanger is landed in the tubular housing.

13. The subsea wellhead assembly according to claim 7, further comprising a tubing annulus port extending through a sidewall of the tubular housing for communication with a tubing annulus surrounding the string of tubing in the well.

14. The subsea wellhead assembly according to claim 7, further comprising upper and lower tubing annulus ports extending through a sidewall of the tubular housing above and below a seal of the tubing hanger, for communication with a tubing annulus surrounding the string of tubing in the well.

15. The subsea wellhead assembly according to claim 7, wherein:

the through-bore in the lower tree member has an inner diameter that is smaller than an outer diameter of the tubing hanger, preventing the tubing hanger from being retrieved through the through-bore of the lower tree member.

16. The subsea wellhead assembly according to claim 7, further comprising:

a tubular stinger extending downward from the upper tree member for stabbing sealingly into the through-bore of the lower tree member simultaneously with the stabbing engagement of the sub with the production line connector.

17. A method of producing fluid from a subsea well having a tubular housing at an upper end of the well, a tubing hanger landed in the tubular housing and supporting a string of tubing extending into the well, the method comprising:

(a) providing a lower tree module with a lower tree member having at least one valve and a production line connector along one side of the lower tree member;

(b) after the tubing hanger has been landed in the tubular housing, lowering the lower tree module along with its valve and landing on an upper end of the tubular housing and, using an external connector, connecting the lower tree member to an exterior portion of the tubular housing;

(c) providing an upper tree module with an upper tree member and at least one flow interface device, and connecting a production line sub alongside the upper tree member;

(d) landing the upper tree member on and, using an external connector, connecting the upper tree member to an exterior portion of the lower tree member to support the upper tree member on the lower tree member;

(e) sealingly engaging a lower end of the sub with the production line connector; then (f) flowing well fluid up the tubing and through the lower and upper tree members and out the production line sub into the production flow line connector; and (g) monitoring and controlling the flow of the well fluid through the lower tree module with the interface device.

18. The method according to claim 17, wherein step (b) occurs before step (d).

19. The method according to claim 17, wherein steps (d) and (e) occur simultaneously.

20. The method according to claim 17, wherein step (d) is carried out on the surface prior to step (b).

* * * * *

UNITED STATES PATENT AND TRADEMARK OFFICE

CERTIFICATE OF CORRECTION

PATENT NO. : 7,647,974 B2
APPLICATION NO. : 11/494030
DATED : January 19, 2010
INVENTOR(S) : Stephen P. Fenton It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 564 days.

Signed and Sealed this

Sixteenth Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,647,974 B2
APPLICATION NO. : 11/494030
DATED : January 19, 2010
INVENTOR(S) : Stephen P. Fenton It is certified that error appears in the above-identified patent and that said Letters Patent is hereby corrected as shown below:

On the Title Page

Item (75) Inventor: delete "Steven" and insert --Stephen-- P. Fenton, Balmedie (GB)

On the Title Page:

The first or sole Notice should read --

Subject to any disclaimer, the term of this patent is extended or adjusted under 35 U.S.C. 154(b) by 564 days.

Signed and Sealed this

Fourteenth Day of December, 2010

David J. Kappos

David J. Kappos
*Director of the United States Patent and Trademark Office*